United States Patent [19]

Priest

[11] Patent Number: 4,917,612

[45] Date of Patent: Apr. 17, 1990

[54] MAGNETIC ELECTRIC POWER CONNECTOR

[76] Inventor: Arthur Priest, C/- Dunalley Post Office, Dunalley, Tasmania 7177, Australia

[21] Appl. No.: 301,584

[22] Filed: Jan. 26, 1989

[51] Int. Cl.[4] ..... H01R 11/30

[52] U.S. Cl. ..... 439/39; 439/38

[58] Field of Search ..... 439/38–40, 439/755, 756, 765, 766

[56] References Cited

U.S. PATENT DOCUMENTS

| | | | |
|---|---|---|---|
| 4,112,941 | 9/1978 | Larimore | 439/39 X |
| 4,390,232 | 6/1983 | Jamgotchian | 439/38 |
| 4,609,238 | 9/1986 | Jamgotchian | 439/39 |

*Primary Examiner*—Steven C. Bishop

*Attorney, Agent, or Firm*—Birch, Stewart Kolasch & Birch

[57] ABSTRACT

A connector for electrically connecting an electrical lead to a terminal of a battery includes a mounting member and a contact member. The mounting member is either connectable to or integral with a terminal post of a battery and includes a mounting magnetic section and an electrical conductor between the battery terminal and the contact member. The contact member is connectable to an electric lead and includes a contact magnetic section coupled with the mounting magnetic section to connect the contact member to the mounting member. Electricity is conducted from the battery terminal to the electric lead via the electrical conductive section and the magnetic sections are outside the major electrical conductive route so that the magnetic sections at least partially insulate the electrical conductive sections.

21 Claims, 2 Drawing Sheets

MAGNETIC ELECTRIC POWER CONNECTOR

BACKGROUND OF THE INVENTION

This invention relates to an electric connector for providing electrical connection between two conductors of electrical energy.

DESCRIPTION OF RELATED ART

Various forms of electrical connectors have previously been proposed and used. Such electrical connectors are generally designed to have male contacts on one side of the connector being firmly held by female clamping contacts on the other side of the connector. Such contacts are often difficult to align and it is difficult to attach or detach one part to or from the other part. Some contacts such as those used for connecting cables to batteries have shown certain deficiencies such as corrosion occurring in the region where the female connector contacts the battery terminal. These battery terminal connectors often distend when tightened and often work loose creating a poor connection thereby resulting in poor current flow, shorting or no current flow.

SUMMARY OF THE INVENTION

It is an object of the present invention to provide an electric connector which overcomes one or more of the aforementioned problems.

The electric connector according to the invention is applicable as a battery terminal connector and it will be convenient to hereinafter describe it in relation to that exemplary application. It is to be appreciated however, that the electric connector is not limited to that application.

According to the present invention there is provided an electric connector for a battery terminal including a mounting member and a contact member, said mounting member being adapted to be detachably secured to a battery terminal and including means such that electricity may be conducted between the battery terminal and the contact members, a mounting magnetic section, a portion of which substantially abuts at least a portion of the contact member; and a receptive recess into which at least a portion of the contact member may insert;

said contact member including electric lead connection means, a contact conductive section to conduct electricity between the mounting member and electric lead and contact magnetic section.

The essential features of the invention, and further optional features are described in detail in the following passages of the specification which refer to the accompanying drawings. The drawings however, are merely illustrative of how the invention might be put into effect, so that the specific form and arrangement of the features (whether they are essential or optional features) shown is not to be understood as limiting the invention.

DETAILED DESCRIPTION OF PREFERRED EMBODIMENTS

Figure 1:
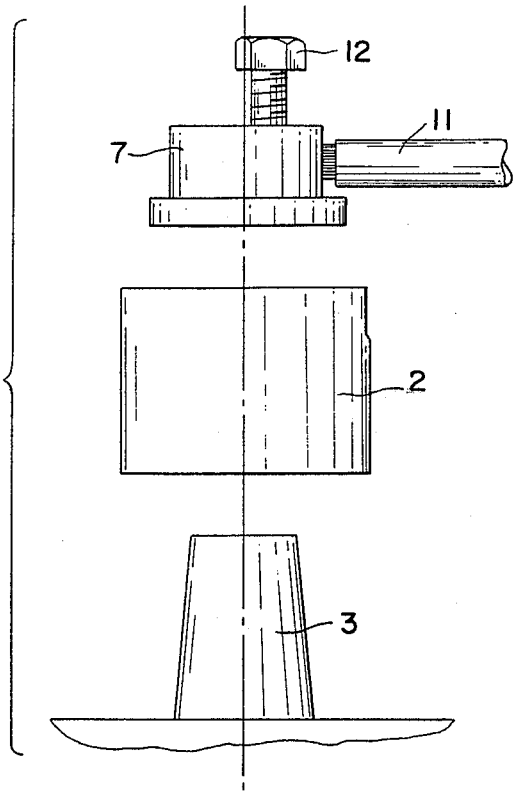
FIG. 1 shows an exploded side view of a battery terminal and one form of electric connector according to the present invention.
Figure 2:
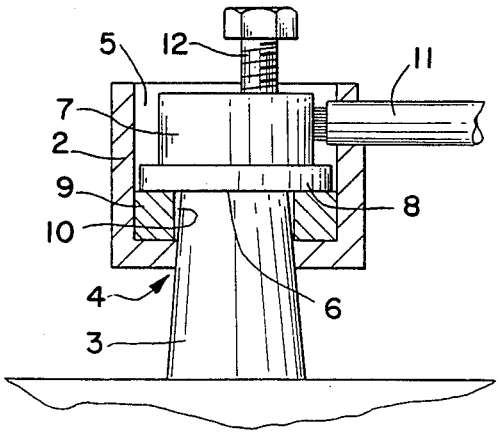
FIG. 2 shows a partially sectioned side view of the battery terminal and electric connector shown in FIG. 1.

According to one form of the present invention as shown in FIGS. 1 and 2, mounting member 2 is adapted to fit about a known male electric conductor 3 of electrical energy. As shown in FIGS. 1 and 2, the male electric conductor 3 is a battery terminal. It will be understood that in a different embodiment of the present invention the mounting member could be formed as an integral part of either the electric conductor or a known female electric conductor.

In the form wherein the mounting member is not integral with the electric conductor it may include attachment means. The attachment means may be of any shape or form depending upon the shape of the electric conductor to which it is to attach. In the form shown in FIG. 1, attachment means includes a receptive recess 4. In this form, the electric conductor 3 is inserted into the receptive recess 4. The receptive recess 4 is substantially complimentary in shape to the electric conductor 3 such that electric conductor 3 can be inserted therein. Electric conductor 3 fits within receptive recess 4 and friction between the electric conductor 3 and the substantially complimentary receptive recess 4 holds the mounting member 2 in place.

Figure 3:
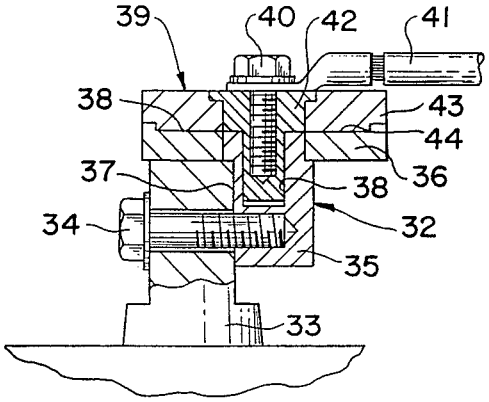
FIG. 3 shows a partially sectional side view of a battery terminal and another form of electric connector according to the invention.

In other forms the attachment means may be any known suitable means including attachment by means of an integral clamp, gluing or melting. An example of a different attachment means is shown in FIG. 3.

The mounting member 2 also includes a locating recess 5. The locating recess 5 is adapted such that at least an abutment zone 6 of contact member 7 may be inserted into locating recess 5 to abut against a saddle section 8.

At least a portion of the saddle section 8 is substantially complimentary in shape to the abutment zone 6 of contact member 7. As shown in FIG. 2, the saddle section 8 forms the base of locating recess 5.

A magnetic member 9 is located in the region of saddle section 8. As shown in FIG. 2, the saddle section 8 is substantially provided by the magnetic member 9. The magnetic member 9 may be any known suitable means including one or more permanent magnets or electric magnets. Magnetic member 9 may be provided with one or more magnets each of which may be any suitable shape. Preferably, magnetic member 9 is ring shaped. The saddle section 8 may be partially or wholly formed by the magnetic member 9.

The mounting member 2 assists in providing electrical communication between the electrical conductor 3 and the contact member 7. As shown in FIG. 2, the electrical conductor 3 inserts into receptive recess 4 and through passage 10 in the saddle section 8 such that a portion of electrical conductor 3 communicates with a portion of surface 6 of contact member 7. In this form, a magnetic member 9 is substantially ring shaped. The passage 10 may be substantially complimentary in shape to the electrical conductor 3 inserted therethrough.

The contact member may be of any suitable shape.

As shown in FIGS. 1 and 2, a lead retaining orifice is provided in the contact member 7 into which the electric lead 11 is inserted and clamping bolt 12 is screwed into clamping engagement so as to lock lead 11 into contact member 7.

It will be appreciated that the electrical lead may be connected by any known means including by soldering, welding or melting.

In FIG. 3 there is shown a different form of electric connector according to the present invention.

A mounting member 32 is attached to an electric conductor 33. A mounting member attachment bolt 34 extends through the electric conductor 33. The attachment bolt 34 inserts into mounting member 32 and detachably secures mounting member 32 in abutment with electric conductor 33 such that electricity may be conducted therethrough.

As shown in FIG. 3, the mounting member 32 is constructed of two sections, including a mounting conductive section 35 to conduct electricity and a mounting magnetic section 36. As shown, the conductive section 35 includes an abutment face 37 which is substantially complimentary in shape to the face of the electric conductor 33 against which abutment face 37 abuts. The conductive section 35 includes a receptive recess 38 and extends through and is connected to the magnetic section 36. The magnetic section 36 includes a locating recess 38.

Detachably abutting with the mounting member 32 is a contact member 39. The contact member 39 may be detached/reattached with the mounting member 32 by the sliding contact member 39 relative to the mounting member 32. Detachably affixed to the contact member 39 by a bolt 40 is an electrical lead 41.

As shown in FIG. 3, contact member 39 comprises two sections including a contact conductive section 42 and a contact magnetic section 43. Contact conductive section 42 includes a boss which is substantially complimentary in shape to at least a portion of receptive recess 38. The boss or conductive section 42 is slidably insertable into receptive recess 38. The conductive section 42 extends through and is connected to the magnetic section 43 and the magnetic section 43, in the vicinity where it abuts mounting member 32, is substantially complimentary in shape and includes a projection 44 insertable into the locating recess 38.

Figure 4:
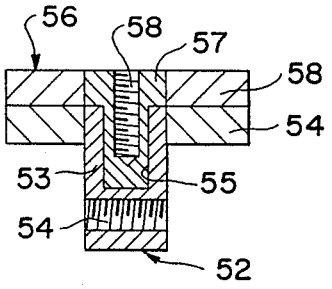
FIG. 4 shows a sectioned side view of a further form of electric connector according to the invention.

In FIG. 4, there is shown a further embodiment of an electric connector according to the present invention.

A mounting member 52 comprises two sections including a mounting conductive section 53 and a mounting magnetic section 54. The conductive section 53 conducts electricity and includes a securing means 54. As shown, the securing means 54 is provided with a screw threaded recess into which a bolt may be inserted to detachably secure the mounting member 52 to an electric conductor. The conductive section 53 also includes a receptive recess 55.

As shown in FIG. 4, the contact member 56 also comprises two sections, including a contact conductive section 57 and a contact magnetic section 58. The contact conductive section 57 extends through and is connected to the magnetic section 58. The conductive section 57 includes a boss which is substantially complimentary in shape to at least a portion of receptive recess 55. The boss of the conductive section 57 is further adapted to be slidably inserted into the receptive recess 55. An electric lead connection recess 58 is provided in the conductive section 57. As shown, the recess 58 is screw threaded and a bolt or other securing means may be used for connecting an electric lead to the conductive section 57.

Figure 5:
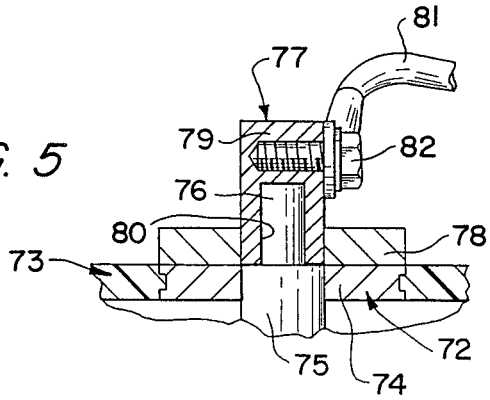
FIG. 5 shows a partially sectioned side view of yet a further form of electric connector according to the invention.

In FIG. 5 there is shown yet a different embodiment of electric connector according to the present invention. As shown, the mounting member 72 is incorporated as an integral part of the electric conductor 73. The mounting member 72 is also an integral part of a battery and comprises two sections including a mounting magnetic section 74 and a mounting conductive section 75. The conductive section 75 extends through and is connected to the magnetic section 74. The magnetic section 74 is integrally set into the surface of battery 73. The conductive section 75 also includes a boss 76.

The contact member 77 comprises a contact magnetic section 78 and contact conductive section 79 which conductive section 79 includes a recess 80 substantially complimentary in shape to the boss 76. The contact member 75 is slidably detachable from the mounting member 72 and an electric lead 81 is affixed to the contact member 77 by a bolt 82.

In any of the embodiments described above, the contact member may be made of any suitable materials including metal, plastic, magnetic material, or a combination of any of these. The contact member may be made of a combination of materials but at least a portion of the contact member in the region which abuts with the mounting member should be of a magnetic material or a magnetically attractive material. At least a portion of the contact member is made of brass, steel or another conductive metal. In one preferred form, the contact member includes both brass, steel or another conductive metal and a polymer magnet. The polymer magnet may be injection molded.

In any of the embodiments shown, the mounting member may be made of any one or more suitable materials including metal, plastic, magnetic materials or a combination of any of these. The mounting member may be made of a combination of materials but at least a portion of the mounting member in the region which abuts with the contact member should be of a magnetic material or a magnetically attractive material. In one preferred form, the mounting member may include brass, steel or another conductive metal and/or plastic and/or a polymer magnet. The polymer magnet may be injection molded.

An electric connector according to the invention may include both the contact member and mounting member having magnetic material included therein or in another form one of the contact or mounting members includes a magnetic material and the other includes a magnetically attractive material.

An electric connector according to the present invention may include a connection means other than magnetic force to connect the contact member with the mounting member. In one form the members may include screw-threads such that the contact member may be screwed to the mounting member.

I claim:

1. A connector for electrically connecting an electrical lead to a terminal of a battery, said connector comprising:

a mounting member and a contact member;

said mounting member being connectable to a terminal post of a battery and including a mounting magnetic section and means for conducting electricity between said battery terminal and said contact member;

said contact member including means to connect an electric lead thereto, an electrical conductive section to conduct electricity to said electric lead, a contact magnetic section to couple with the mounting magnetic section to connect the contact member to the mounting member such that electricity may be conducted from the battery terminal to said electric lead via said electrical conductive section and wherein the magnetic sections are outside the major electrical conductive route and wherein the magnetic sections at least partially insulate said electrical conductive sections.

2. A connector as claimed in claim 1 wherein said mounting member includes a receptive recess through which at least a part of said battery terminal inserts and which provides means to connect said mounting member to said terminal.

3. A connector as claimed in claim 1 or 2 wherein said mounting member includes at least one locating recess which assists in an locating said contact member in abutment position relative to said mounting member.

4. A connector as claimed in claim 3 wherein at least a portion of said mounting member connects to said battery terminal post by abutment and at least a part of said portion is made of an electrically conductive material to provide an electrically conductive mounting member section.

5. A connector as claimed in claim 4 wherein said electrically conductive mounting member section includes a receptive recess which is substantially complimentary in shape to an electrically conductive boss projecting from said contact member and is cooperable with said boss such that when the mounting member and contact member are in abutment electricity may be conducted between said electrically conductive sections.

6. A connector as claimed in claim 1, wherein said electrically conductive sections are formed of a substantially non-magnetically conductive material.

7. A connector as claimed in claim 2, wherein said electrically conductive sections are formed of a substantially non-magnetically conductive material.

8. A connector as claimed in claim 3, wherein said electrically conductive sections are formed of a substantially non-magnetically conductive material.

9. A connector for electrically connecting an electrical lead to a terminal of a battery, said connector comprising:

a mounting member; and a contact member;

said mounting member being formed as at least a portion of a battery terminal and including an electrically conductive post which projects from said battery, said mounting member including a mounting magnetic section;

said contact member being cooperable with said post, said contact member including means for connecting an electric lead thereto, an electrically conductive section to conduct electricity to said lead, a magnetic section cooperable with the mounting magnetic section to couple the contact member to the mounting member such that electricity may be conducted from the electrically conductive post to said electric lead via said electrically conductive section, wherein the magnetic sections are outside of the major electrical conductive route and wherein the magnetic sections at least partially insulate said electrical conductive sections.

10. A connector as claimed in claim 9 wherein at least one locating recess is provided to assist in locating said contact member in a conductive abutment position relative to said mounting member.

11. A connector as claimed in claim 9 or 10 wherein said electrically conductive contact member section includes a receptive recess which is substantially complimentary in shape to said electrically conductive post and is cooperable with said post such that when the mounting member and contact member are in abutment electricity may be conducted therebetween.

12. A connector as claimed in claim 9, wherein said mounting magnetic section is integrally formed with said battery.

13. A connector for electrically connecting an electrical lead to a terminal of a battery, said connector comprising:

a mounting member; and a contact member;

said mounting member being integral with the terminal of a battery and including a mounting magnetic section and means for conducting electricity between said battery terminal and said contact member;

said contact member including means for connecting an electric lead thereto, an electrical conductive section to conduct electricity to said electric lead, a contact magnetic section to couple with the mounting magnetic section to connect the contact member to the mounting member such that electricity may be conducted from the battery terminal to said electric lead via said electrical conductive section and wherein the magnetic sections are outside the major electrical conductive route and wherein the magnetic sections at least partially insulate said electrical conductive sections.

14. A connector for electrically connecting an electrical lead to a terminal of a battery, said connector comprising:

a mounting member; and a contact member;

said contact member including means for connecting an electrical lead thereto, including an electrically conductive post in contact with an electrically conductive section to conduct electricity to said lead;

said mounting member being formed as at least a portion of the terminal of the battery and cooperable with said electrically conductive post and including an electrical conductive section;

said mounting member and said contact member each including magnetic sections cooperable with each other to couple the mounting member to the contact member such that when the mounting member and contact member are in abutment electricity may be conducted to said lead via said electrically conductive sections including said boss;

wherein the magnetic sections are outside of the major electrical conductive route and wherein the magnetic section at least partially insulates said electrical conductive sections.

15. A connector as claimed in claim 14, wherein at least one locating recess is provided to assist in locating said contact member in a conductive abutment position relative to said mounting member.

16. A connector as claimed in claim 14, wherein said electrically conductive sections including said boss are formed of a substantially non-magnetically conductive material.

17. A connector as claimed in claim 15, wherein said electrically conductive sections including said boss are formed of a substantially non-magnetically conductive material.

18. A connector for electrically connecting an electrical lead to a terminal of a battery, said connector comprising:

a mounting member; and a contact member;

said contact member including means for connecting an electrical lead thereto, including an electrically conductive post which is integral with an electrically conductive section to conduct electricity to said lead;

said mounting member being formed as at least a portion of a battery terminal and cooperable with said post and including an electrical conductive section;

said mounting member and said contact member each including magnetic sections cooperable with each other to couple the mounting member to the contact member such that when the mounting member and contact member are in abutment electricity may be conducted to said lead via said electrically conductive sections including said boss;

wherein the magnetic sections are outside of the major electrical conductive route and wherein the magnetic section at least partially insulates said electrical conductive sections.

19. A connector as claimed in claim 18, wherein at least one locating recess is provided to assist in locating said contact member in a conductive abutment position relative to said mounting member.

20. A connector as claimed in claim 18, wherein said electrically conductive sections including said boss are formed of a substantially non-magnetically conductive material.

21. A connector as claimed in claim 19, wherein said electrically conductive sections including said boss are formed of a substantially non-magnetically conductive material.

* * * * *